United States Patent [19]

Allen

[11] 4,194,602

[45] Mar. 25, 1980

[54] CONVERTIBLE BAG ASSEMBLY

[76] Inventor: Herbert Allen, 3207 Groveland La., Houston, Tex. 77019

[21] Appl. No.: 903,728

[22] Filed: May 8, 1978

[51] Int. Cl.[2] ..... A45C 13/26

[52] U.S. Cl. ..... 190/57; 224/46 R; 224/47; 224/235; 224/250; 150/33

[58] Field of Search ..... 224/5 R, 5 Q, 8 R, 9, 224/26 R, 31, 46 R, 47; 150/1.7, 33, 12; 190/57, 58

[56] References Cited

U.S. PATENT DOCUMENTS

| | | | |
|---|---|---|---|
| 511,690 | 12/1893 | Edwards | 224/8 |
| 811,215 | 1/1906 | Goldsmith | 150/33 |
| 1,121,566 | 12/1914 | McKee | 224/47 |
| 1,370,636 | 3/1921 | Dwyer | 224/8 R |
| 2,542,246 | 2/1951 | Grosz | 224/46 R |
| 2,712,336 | 7/1955 | Casselman | 150/12 |
| 3,019,952 | 2/1962 | Brewster | 190/57 |
| 3,259,285 | 7/1966 | Bush | 224/46 R |

FOREIGN PATENT DOCUMENTS

| | | | |
|---|---|---|---|
| 494731 | 7/1950 | Belgium | 150/33 |
| 22108 | of 1906 | United Kingdom | 150/12 |
| 624998 | 6/1949 | United Kingdom | 224/5 Q |

*Primary Examiner*—Ro E. Hart

[57] ABSTRACT

There is disclosed a convertible bag assembly comprising a bag body and a carrier in the form of a closed loop. The carrier includes a pair of handle segments and a pair of flexible support segments adjoining the handle segments in alternating end-to-end relation. The support segments are slidably carried by the bag body for movement of the carrier member between a first position in which the handle segments are retained in relatively close proximity to the bag body and a second position in which the handle segments may be extended upwardly from the first position.

5 Claims, 7 Drawing Figures

Fig. 1
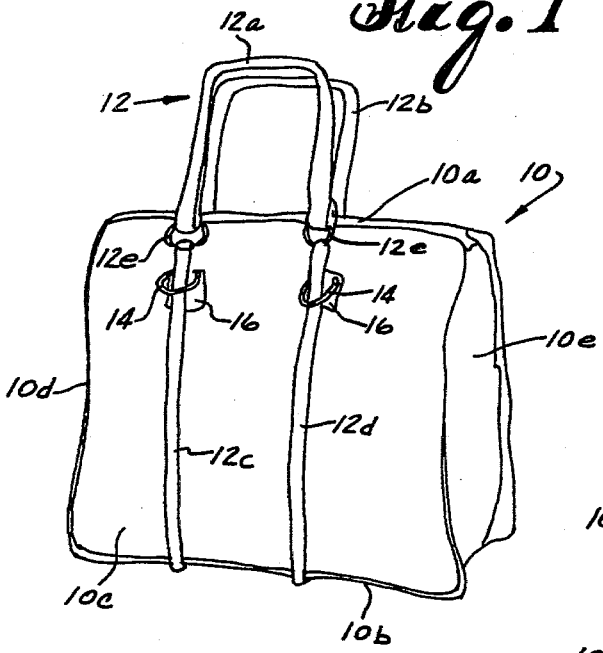
Fig. 2
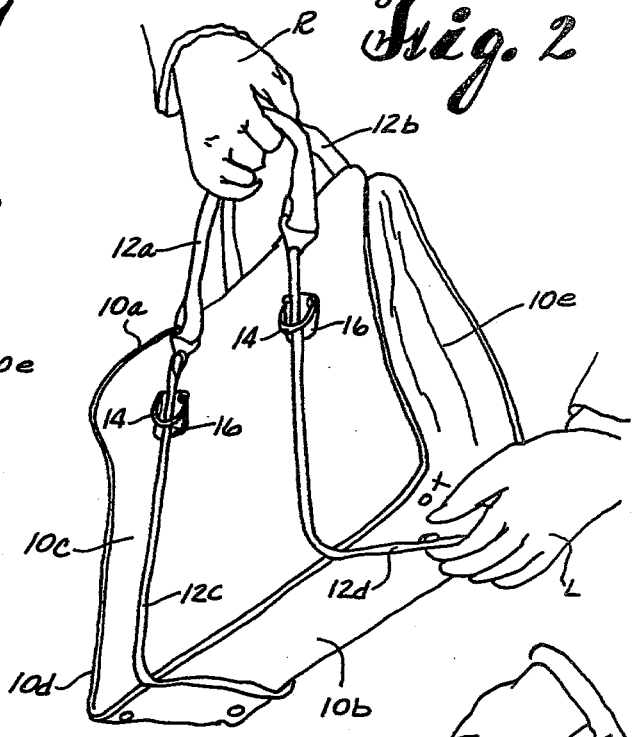
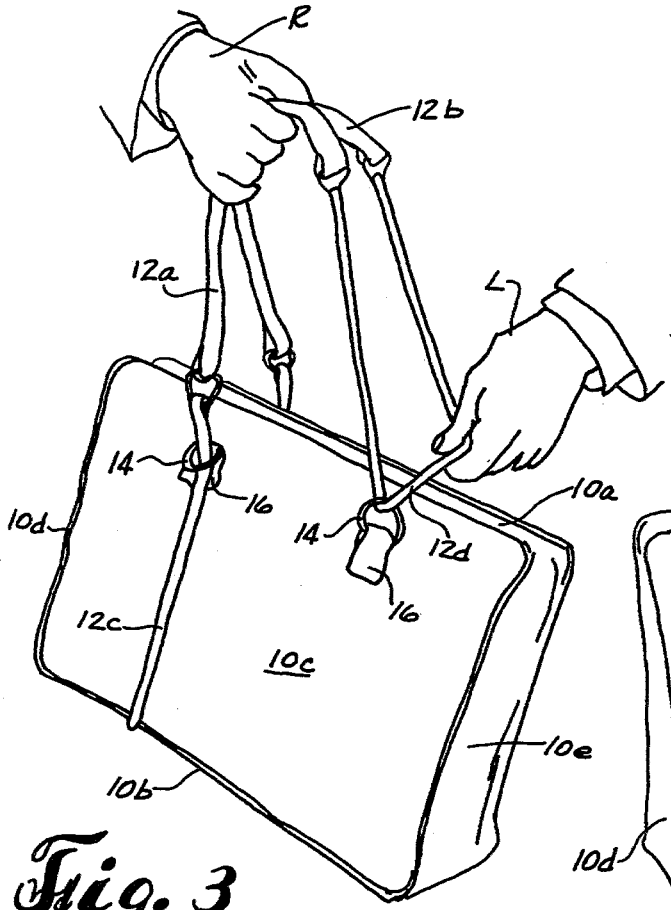
Fig. 3
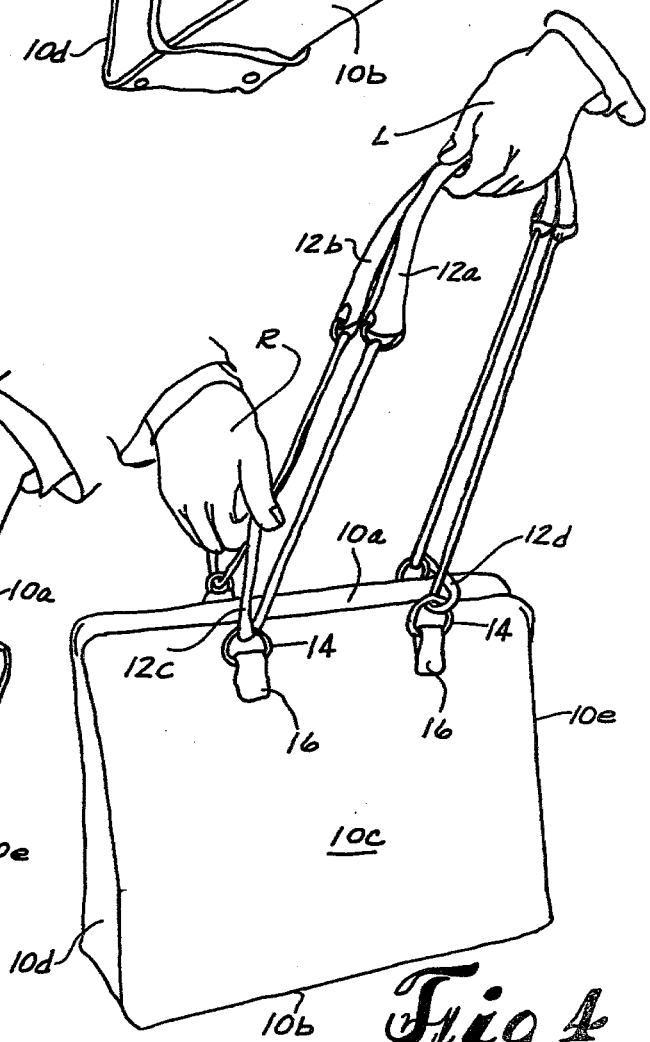
Fig 4

CONVERTIBLE BAG ASSEMBLY

BACKGROUND OF THE INVENTION

1. Field of the Invention

The present invention pertains to bags convertible from a hand held form to a shoulder supported form. The invention is particularly advantageous in connection with travel bags of an intermediate size such as flight bags or tote bags which a traveller may wish to carry on board a vehicle rather than check with his larger pieces of luggage. In the course of travelling, there are times when a shoulder supported bag is most convenient since it leaves the traveller's hands free to present tickets and passports, make change, etc. However, at other times it is more convenient to hold the bag in one's hand in which case the relatively long strap of a shoulder bag is awkward and unwieldy.

2. Description of the Prior Art

Several schemes have been devised for converting a bag from a hand held form to a shoulder supported form. However, none of these is totally satisfactory. One common disadvantage with many prior art convertible bags is that the manner of converting the bag from one form to another is too complicated and/or time consuming to be easily performed by a person holding the bag, particularly in a standing position. Some such bags are virtually impossible to convert unless rested on a counter, one's lap or some other support. Another disadvantage with many prior art bags is that they involve the use of buckles, latches, snaps, or the like which are not only subject to malfunction, but which may also increase the cost of the bag.

SUMMARY OF THE INVENTION

The present invention provides an improved bag which is simple in form and easily and quickly convertible between hand held and shoulder supported form while supporting the bag with the hands, even in a standing position. The invention eliminates the need to employ buckles, latches, snaps or other such mechanisms for accomplishing the conversion, thereby simplifying the operation and virtually eliminating the chance of malfunction. Furthermore, the invention may serve to enhance the appearance of the bag.

In particular, the present invention comprises a convertible bag assembly including a bag body and a carrier member. The carrier member is in the form of a closed loop and includes handle means and flexible support means adjoining the handle means. The support means are slidably carried by the bag body for movement of the carrier member between a first position in which the handle means are retained in relatively close proximity to the bag body for holding in the hand and a second position in which handle means may be extended upwardly from the first position for resting on the user's shoulder.

In the preferred embodiments of the invention, the handle means comprise a pair of handle segments and the support means comprise a pair of support segments, the handle segments and support segments being adjoined in alternating end-to-end relation to form the aforementioned closed loop. However, while these various segments may be separate parts connected together in such loop, the loop may alternatively be an integral substantially uniform member, various portions of which form the respective handle and support segments by virtue of their position and function with respect to the bag body.

The handle segments are, in the first and second positions, preferably positioned generally parallel to each other, and the support segments are likewise positioned generally parallel to each other and slidably received in retainer means on opposite sides of the bag body. In the first or hand held position the support segments extend from the retainer means on one side of the bag body to the retainer means on the other side under the bottom of the bag body to support the body by the bottom. In the second or shoulder supported position, the support segments extend from the retainer means on one side of the bag body to the retainer means on the other side over the top of the bag body to support the body by the retainer means. Thus the support segments may be moved between the first and second positions by passing respective ones of the support segments along respective ones of the ends of the bag body from the top to the bottom and vice versa.

Accordingly it is a principal object of the present invention to provide an improved convertible hand-shoulder bag.

Another object of the present invention is to provide a quick and simple means for conversion of a bag from a hand held to a shoulder supported form.

Still another object of the invention is to provide a means for conversion of such a bag without the use of buckles, latches, snaps or like mechanisms.

Yet a further object of the present invention is to provide a convertible bag assembly having a carrier member in the form of a continuous closed loop slidably carried by the bag body.

Still other objects, features and advantages of the invention will be made apparent by the following description of the preferred embodiments, the drawings, and the claims.

BRIEF DESCRIPTION OF THE DRAWINGS

FIG. 1 is a perspective view of a convertible bag according to the invention in hand held form.

FIGS. 2, 3 and 4 are perspective views of the bag showing successive steps in the process of converting the bag to a shoulder supported form.

DESCRIPTION OF THE PREFERRED EMBODIMENTS

Figure 5:
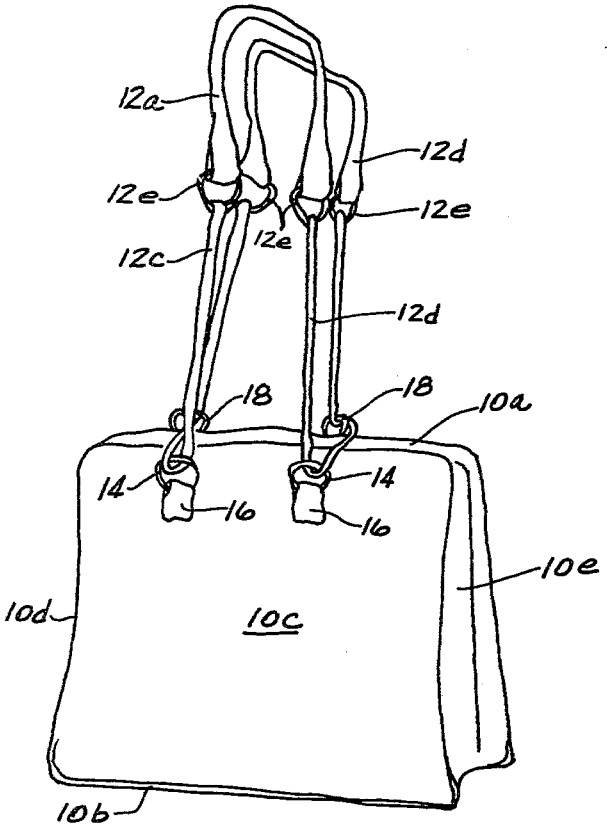
FIG. 5 is a perspective view of the bag in shoulder supported form.

Referring now to the drawings, there is shown a convertible bag according to the present invention comprising a bag body 10 and a carrier member 12. As shown, the bag assembly is in the form of a travel bag of the size and shape commonly referred to as a flight bag or tote bag. However, it will be appreciated that the invention is applicable to other types of bags such as purses, camera bags, brief cases, school bags, etc.

The bag body 10 comprises a top **10*a*, a bottom 10*b*, opposite sides—one of which is shown at 10*c*, and opposite ends 10*d* and 10*e***.

The carrier member 12 comprises a pair of handle segments **12*a* and 12*b* and a pair of support segments 12*c* and 12*d* connected in end-to-end relation by rings 12*e* to form a closed loop. The handle segments 12*a* and 12*b* and support segments 12*c* and 12*d* are positioned alternately, i.e. with handle segments 12a and 12b interposed between support segments 12c and 12d, whereby, in the first and second positions shown in FIGS. 1 and 5 respectively, the handle segments 12a and 12b may be positioned generally parallel to each other and the support segments 12c and 12d** may likewise be positioned generally parallel to each other.

In the embodiment shown, the handle segments 12a and 12b and support segments 12c and 12d are separate parts connected together to form the closed loop. However, in other embodiments, the carrier member may be an integral, substantially uniform member, and the various portions of such a member would form the various segments mentioned above. Accordingly, the term "segments" as used herein may denote various portions of an integral uniform member differentiated by their positions or functions in use. Furthermore, as will be explained more fully below, the carrier member is freely slidably carried by the bag body in a manner such that various portions of the carrier member may be repositioned so as to serve as handle segments at one time and support segments at another time. Likewise, the terms "adjoined" and "adjoining" will be construed to include integral formations as well as connections of separate parts.

Referring again to the drawings, in the embodiment shown, the handle segments 12a and 12b are formed of padded vinyl, leather, or other like material for comfort in engagement with the user's hand or shoulder. The support segments 12c and 12d may also be formed of leather or vinyl as well as any other strong, flexible material such as chain link, woven fabric, rope, etc. depending on the intended use of the bag and the visual effect desired.

As shown in FIG. 1, side 10c of the bag body 10 has a pair of rings or eyelets 14 affixed thereto by respective flexible loops 16 of vinyl, leather, fabric or the like which pass through the eyelets 14. Loops 16 may be secured to side 10c by stitching, adhesive, or in any other suitable manner. The loops 16 with their respective eyelets 14 are horizontally spaced apart from each other on side 10c of the bag body 10 and are spaced slightly from the top 10a of the body, but substantially closer to the top 10a than to the bottom 10b of the bag body. Each of the support segments 12c and 12d is slidably received in a respective one of the eyelets 14 which, together with loops 16, thus serve as retainer means for mounting and positioning the carrier member 12 on the bag body 10. The side of the bag body opposite side 10c has an identical pair of eyelets 18 (see FIG. 5) secured thereto by loops (not shown) such as 16 and slidably receiving respective ones of the support segments 12c and 12d.

FIG. 1 shows the bag assembly in hand held form with the carrier member 12 in a first position with respect to the bag body 10. In this first position, the support segments 12c and 12d extend through respective eyelets 14, downwardly along side 10c of the bag body, under the bottom 10b of the body, upwardly along the side of the bag body opposite side 10c, and through respective retaining eyelets 18 (not visible in FIG. 1) on said opposite side. In this first position, virtually the entire lengths of the support segments 12c and 12d are disposed along the sides and bottom of the bag body so that the adjoining handle segments 12a and 12b are retained in close proximity to the top 10a of the bag body for convenience in carrying the assembly by hand. When the assembly is lifted by the handle segments 12a and 12b, support segments 12c and 12d support the bag body by its bottom 10b. Support segments 12c and 12d also form an attractve trim along the sides of the bag body.

To convert the bag assembly from the hand held form shown in FIG. 1 to a shoulder supported form, the assembly may be supported in one hand, e.g. the right hand R, by gripping the handle segments 12a and 12b as shown in FIG. 2. The user may then grasp with the other hand, in this case, left hand L, the portion of one of the support segments 12d which lies across the bottom 10b of the bag body as shown in FIG. 2. This portion of the support segment 12d is passed upwardly along the adjacent end 10e of the bag body and over the top 10a of the bag body as shown in FIG. 3. The user may now grip handle segments 12a and 12b with his left hand L as shown in FIG. 4 to support the assembly while using his right hand R to draw the other support segment 12c upwardly along the adjacent end 10d of the bag body and over the top 10a thereof.

The bag assembly is thus converted to a shoulder supported form shown in FIG. 5. It will be apparent that numerous modifications of the manner of gripping and manipulating the bag assembly to effect such conversion can be made, and the above procedure is outlined primarily to demonstrate one convenient method. This exemplary method demonstrates that the bag can be quickly and easily converted from hand held to shoulder supported form without the need to rest the bag on a counter, one's lap or some other support. Rather, the entire process may be accomplished while the bag is supported in the user's hands and even in a standing position.

As shown in FIG. 5, when the bag assembly is in its shoulder supported form, the carrier member 12 is in a second position in which each of the support segments 12c and 12d extends from a respective eyelet 14 on side 10c of the bag body to a similar eyelet 18 on the opposite of the bag body over the top thereof. This permits a substantial portion of the lengths of support segments 12c and 12d along with the adjoining handle segments 12a and 12b to be pulled upwardly from the first position (compare FIG. 1). This provides sufficient clearance between the top 10a of the bag body and the handle segments 12a and 12b for the user to place the handle segments 12a and 12b over his shoulder. The support segments 12c and 12d then support the bag body 10 by the eyelets 14, 18 and loops 16, etc.

Figure 6:
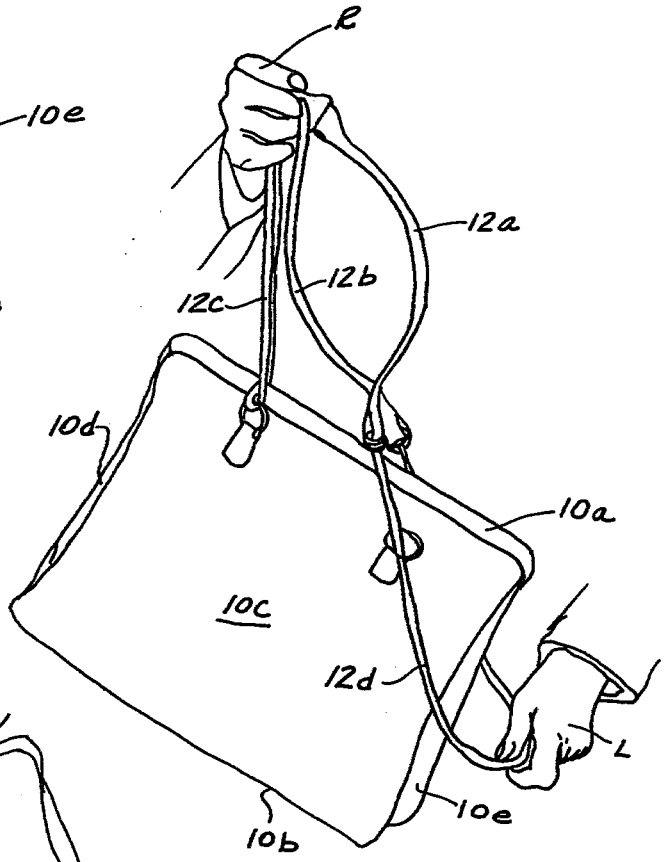
FIGS. 6 and 7 are perspective views of the bag showing successive steps in the process of converting the bag back to a hand held form.
Figure 7:
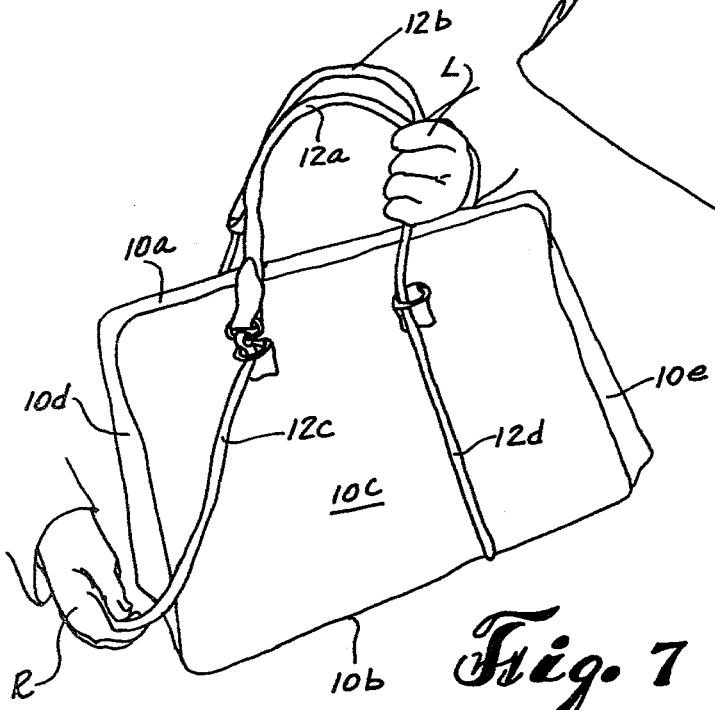

FIGS. 6 and 7 illustrate an exemplary method by which the bag can be re-converted into hand held form, again while supporting the bag assembly solely in the user's hands. As shown in FIG. 6, while gripping one of the support segments 12c with the right hand R, the user can use his left hand L to draw the portion of the other support segment 12d from the top 10a of the bag body downwardly along end 10e and under the bottom 10b. Supporting the bag assembly by segments 12c provides sufficient slack in the carrier member to facilitate the movement of the other segment 12d. Then, as shown in FIG. 7, the user may use his left hand L to grip the handle segments 12a and 12b, preferably near their junction with the support segments 12d last moved—again to provide slack. While supporting the assembly in this manner, the user may then use his right hand R to move the remaining support segment 12c from its second position overlying the top 10a of the bag body downwardly along end 10d to its first position underlying the bottom 10b of the bag body. Thus the carrier member 12 has been returned to its first position and the bag assembly has been re-converted to the hand held form shown in FIG. 1.

It can thus be seen that the present invention provides an improved convertible bag which is particularly convenient to convert from one form to another; which eliminates buckles, snaps, latches, and other such mechanisms; and which presents an attractive appearance in either of its forms.

It will also be realized that numerous modifications of the preferred embodiments described above may be made within the spirit of the invention. It is thus intended that the scope of the invention be limited only by the claims which follow.

I claim:

1. A convertible bag assembly comprising:

a bag body including a top, a bottom, a pair of opposite sides, and a pair of opposite ends, and having retainer means on each of said sides; and a carrier member comprising a pair of handle segments and a pair of flexible support segments adjoined in alternating end-to-end relation to form a closed loop, said carrier member being freely slidably carried by said bag body by slidable receipt of said support segments in said retainer means for movement of the carrier member between a first position in which said support segments extend from the retainer means on one side of said bag body to the retainer means on the other side of said bag body under the bottom of said bag body to retain said handle means in relatively close proximity to the top of said bag body and a second position in which said support segments extend from the retainer means on one side of said bag body to the retainer means on the other side of said bag body over the top of said bag body whereby said handle means by extended upwardly from said first position, said support segments being movable between said first and second positions by passing respective ones of said support segments over respective ones of said ends of said bag body.

2. The bag assembly of claim 1 wherein in said first and second positions said handle segments are positioned generally parallel to each other and said support segments are positioned generally parallel to each other, said support segments in said first position supporting said bag body by said bottom, and said support segments in said second position supporting said bag body by said retainer means.

3. The bag assembly of claim 2 wherein the retainer means on each side of said bag body include a pair of horizontally spaced apart retainer members each slidably receiving a respective one of said support segments.

4. The bag body of claim 3 wherein each of said retainer means comprises an eyelet mounted on said bag body.

5. The bag assembly of claim 1 wherein said retainer means are substantially closer to the top of said bag body than to the bottom.

* * * * *

UNITED STATES PATENT AND TRADEMARK OFFICE

CERTIFICATE OF CORRECTION

PATENT NO. : 4,194,602

DATED : March 25, 1980

INVENTOR(S) : Herbert Allen

It is certified that error appears in the above-identified patent and that said Letters Patent are hereby corrected as shown below:

In Claim 1, Column 6, line 6, after "means" delete "by" and insert therefor --may be--.

Signed and Sealed this

*Ninth* Day of *June 1981*

[SEAL]

*Attest:*

RENE D. TEGTMEYER

*Attesting Officer*

*Acting Commissioner of Patents and Trademarks*